US008450544B2

(12) United States Patent
Tsao et al.

(10) Patent No.: US 8,450,544 B2
(45) Date of Patent: May 28, 2013

(54) METHOD FOR PREPARING HIGH ENERGY FUELS

(75) Inventors: Ying-Yen Tsao, Jia-Yi (TW); Chyuan-Neng Liao, Jia-Yi (TW); Chi-Yu Chen, Jia-Yi (TW); Chin-Ming Lin, Jia-Yi (TW); Kuo-Min Wei, Jia-Yi (TW)

(73) Assignee: CPC Corporation, Taiwan, Taipei (TW)

( * ) Notice: Subject to any disclaimer, the term of this patent is extended or adjusted under 35 U.S.C. 154(b) by 1001 days.

(21) Appl. No.: 11/733,073

(22) Filed: Apr. 9, 2007

(65) Prior Publication Data

US 2008/0249341 A1 Oct. 9, 2008

(51) Int. Cl.

| | |
|---|---|
| ***C07C 5/22*** | (2006.01) |
| ***C07C 5/00*** | (2006.01) |
| ***C10G 67/00*** | (2006.01) |

(52) U.S. Cl.

USPC ..... 585/253; 585/14; 585/254; 208/16; 208/49; 44/300

(58) Field of Classification Search

USPC ..... 585/253, 254; 208/49

See application file for complete search history.

(56) References Cited

U.S. PATENT DOCUMENTS

| | | | | |
|---|---|---|---|---|
| 3,381,046 | A * | 4/1968 | Cohen et al. | 585/22 |
| 4,086,284 | A | 4/1978 | Schneider et al. | |
| 4,107,223 | A | 8/1978 | Schneider et al. | |
| 4,177,217 | A | 12/1979 | Janoski et al. | |
| 4,270,014 | A | 5/1981 | Norton et al. | |
| 4,288,644 | A | 9/1981 | Janoski et al. | |
| 4,398,978 | A | 8/1983 | Burdette et al. | |

FOREIGN PATENT DOCUMENTS

| | | | |
|---|---|---|---|
| WO | WO 00/43467 | * | 7/2000 |
| WO | WO 0043467 A1 | * | 7/2000 |
| WO | WO 01/23332 | * | 4/2001 |
| WO | WO 0123332 A1 | * | 4/2001 |

* cited by examiner

*Primary Examiner* — Ellen McAvoy
*Assistant Examiner* — Ming Cheung Po
(74) *Attorney, Agent, or Firm* — Birch, Stewart, Kolasch & Birch, LLP

(57) ABSTRACT

A method for preparing the low carbon number petrochemical products along with the high energy fuels from pyrolysis gasoline is provided. In this method, the pyrolysis gasoline is used as feedstock, and the reactive non-aromatic, unsaturated moieties, and the sulfur impurity contained in the pyrolysis gasoline are removed. Then the stabilized feedstock is used to produce $C_5$ olefins, $C_6$-$C_9$ aromatic hydrocarbons as petrochemical products, and $C_{10}^+$ hydrocarbons as precursors of high energy fuels. Upon acid catalytic isomerization, or upon crystallization followed by acid catalytic isomerization, the $C_{10}^+$ hydrocarbons as precursors of high energy fuels are converted to exo-isomers as high energy fuels.

28 Claims, 8 Drawing Sheets

METHOD FOR PREPARING HIGH ENERGY FUELS

BACKGROUND OF THE INVENTION

1. Field of the Invention

The present invention generally relates to a method for preparing the high energy fuels, and more particularly to a method for preparing the low carbon number petrochemical products along with the high energy fuels from pyrolysis gasoline (pygas) used as feedstock.

2. The Prior Arts

The major constituent of the high-density liquid hydrocarbon fuels for propelling missile systems is Jet Propellant 10 (JP-10), which is a $C_{10}$ cyclic hydrocarbon, and contains >98.5 wt % of exo-tetrahydrodicyclopentadiene (exo-THDCPD), and <1.5 wt % of endo-tetrahydrodicyclopentadiene (endo-THDCPD). JP-10 has the characteristics of high volumetric heating value, low freezing point high thermal stability, and low viscosity, and thereby no other aviation fuels having a similar boiling point as JP-10 can compete with JP-10 in fueling. Up to now, the high density fuel of JP-10 is chemically synthesized using the pure compounds as starting material, and which will cause high manufacturing cost. The price of JP-10 is sixteen to eighteen times of the prices of other aviation fuels. Therefore, JP-10 is almost exclusively used in missile applications.

In the prior art, JP-10 is prepared by first completely hydrogenating extra-high purity cyclopentadiene (CPD) dimer, namely dicyclopentadiene (DCPD, freezing point of 33.6° C.), as a precursor to yield the solid endo-isomer of the hydrogenated derivative, namely endo-THDCPD (freezing point of 77° C.), wherein the hydrogenation of DCPD is carried out in two stages (the first stage and the second stage). In the first stage, the dihydro derivative, namely dihydrodicyclopentadiene (DHDCPD, freezing point of 51° C.) was obtained by selective hydrogenation of DCPD in the presence of nickel or palladium catalyst at the temperature of 50-120° C. In the second stage, the solid endo-THDCPD (freezing point of 77° C.) was obtained by hydrogenation of DHDCPD in the presence of metal catalyst at the temperature of 130-220° C. Finally, the solid endo-THDCPD is isomerized to the liquid exo-THDCPD, namely JP-10 (freezing point <−79° C.), in an amount of more than 98.5% of the total product weight in the presence of an acidic catalyst. JP-10 is very expensive because it is obtained by chemical synthesis from extra-high purity DCPD using a batch reactor (referring to U.S. Pat. Nos. 3,381,046, 4,086,284, 4,107,223, and 4,270,014).

The amount of DCPD precursor (less than 1 to 2 million pounds per year) that is used in preparing JP-10 accounts for around 1% of the total global production of DCPD. DCPD is mainly used as monomers in the production of many copolymers. However, DCPD and CPD monomer thereof are mainly obtained from pygas that is a by-product of ethylene production from steam crackers. DCPD is produced by first separating the $C_5$ fractions (the term $C_5$ refers to the hydrocarbons containing five carbon atoms) from the pygas fed to a depentanizer, and then by dimerizing CPD present in the $C_5$ fractions by heat soaking at the temperature ranging from 100 to 120° C. After distillation of the crude $C_{10}$ fractions, DCPD is withdrawn from the bottom of the depentanizer, which can be separated from the undimerized $C_5$ hydrocarbons withdrawn from the top of the depentanizer. The high-purity (>98-99%) DCPD usually is obtained by thermal cracking (pyrolysis) of 75-90% purity of crude DCPD to CPD at the temperature ranging from 170 to 172° C. and then distilling the CPD off from the hydrocarbon mixture. The thus obtained CPD distillate is dimerized during heat soaking at the temperature ranging from 100 to 120° C. to form DCPD. The production cost of DCPD is very high because DCPD is obtained by repeating the steps of thermal crack and dimerization.

The high-energy fuels of RJ-4 and RJ-4I ($C_{12}$ cyclic hydrocarbons), which have the similar structures as that of JP-10, were also produced by chemical synthesis (referring to U.S. Pat. No. 4,398,978). RJ-4 and RJ-4I both comprise endo-tetrahydrodimethyldicylopentadiene (endo-THDMCPD) and exo-tetrahydrodimethyldicyclopentadiene (exo-THDMCPD) isomers, but in different ratio. RJ-4 and RJ-4I were obtained by using methylcyclopentadiene (MCPD, $C_6$ cyclic hydrocarbons) as a precursor and following the same reaction mechanism as that for converting CPD to DCPD. RJ-4 or RJ-4I is prepared by first dimerizing MCPD to form dimethyldicyclopentadienes (DMCPD), followed by completely hydrogenating DMCPD to produce the endo stereo isomeric form of the tetrahydro derivative, namely tetrahydrodimethyldicyclopentadienes, wherein the complete hydrogenation of DMCPD is carried out in two stages. In the first stage, DMCPD is converted to endo-dihydrodimethylcyclopentadienes (endo-DHDMCPD), and in the second stage, endo-DHDMCPD is converted to endo-THDMCPD. Finally, portions of the endo-THDMCPD isomers are isomerized to the exo-THDMCPD isomers in the presence of acidic catalyst RJ-4I has a lower freezing point and viscosity than RJ-4 since RJ-4I has more exo-THDMCPD isomers produced than RJ-4 has (referring to U.S. Pat. No. 4,398,978).

According to the same reaction mechanism, as mentioned above, endo-tetrahydro CPD/MCPD is prepared by first codimerizing CPD ($C_5$ cyclic hydrocarbons) with MCPD ($C_6$ cyclic hydrocarbons) by heat soaking at the temperature ranging from 100 to 120° C. to form endo-CPD/MCPD codimer ($C_{11}$ cyclic hydrocarbons), followed by completely hydrogenating endo-CPD/MCPD codimer to produce the endo stereo isomeric form of the tetrahydro derivative, namely endo-tetrahydro CPD/MCPD codimer (endo-THMDCPD). The complete hydrogenation of endo-CPD/MCPD codimer is carried out in two stages. In the first stage, endo-CPD/MCPD codimer is converted to endo-dihydro CPD/MCPD codimer (DHMDCPD), and in the second stage, endo-dihydro CPD/MCPD codimer is converted to endo-tetrahydro CPD/MCPD codimer (endo-THMDCPD). Finally, portions of the endo-THMDCPD isomers are isomerized to the exo-THMDCPD isomers in the presence of acidic catalyst. The compositions of the $C_{11}$ high energy fuels and the method for preparing the same have been disclosed by U.S. Pat. No. 4,398,978. The $C_{11}$ high energy fuels have combustion characteristics fallen between those of JP10 and RJ-4I. However, no specific fuel names were assigned to the $C_{11}$ high energy fuels since the $C_{11}$ high energy fuels which can be used as liquid missile fuels have not been manufactured in mass production by chemical synthesis so far.

On the other hand, the principal product from naphtha steam cracker is ethylene. However, other heavier by-products as petrochemical feedstocks are also produced, such as $C_4$-$C_5$ diolefins, styrene, methylstyrene, and DCPD in addition to benzene, toluene, and xylene. The pygas by-products from naphtha steam cracker are usually blended with gasoline or fuel if the naphtha steam crackers are small-sized ones without the need of petrochemical feedstocks. The composition of pygas blended with gasoline and fuel is different from the composition of pygas used as a petrochemical feedstock because the pygas, which is to be blended with gasoline or fuel, need to be further treated. These small-sized naphtha steam crackers usually have the two-stage hydrogenation equipments used for converting the $C_8^-$ active constitutes (the term $C_8^-$ refers to the hydrocarbons containing eight or less carbon atoms), such as diolefins and styrene, contained in the pygas into more stable products. For example, styrene is hydrogenated to ethylbenzene. Therefore, the hydrotreated pygas can be stabilized for later blending and storage, and moreover the coking and clogging will not occur in distillation equipments and oil pipelines during the follow-on treatments. During the second-stage hydrogenation, the residual olefins were completely saturated with hydrogen, and also the sulfur containing species present in the petrochemical feedstock are removed by converting them to hydrogen sulfide. Therefore, the reaction conditions and the catalyst formulations used for the second-stage hydrogenation operated at the small-sized naphtha steam crackers are different from those used for the above-mentioned second-stage hydrogenation of the chemically synthesized DHDCPD, DHMDCPD, and DHDMCPD. The second-stage hydrogenation catalyst for pygas is typically prepared by first combining the high surface area CoMo oxide catalyst with the high surface area NiMo oxide catalyst to form a CoMo/NiMo oxide dual catalyst system, followed by transforming the CoMo/NiMo oxide dual catalyst system to a sulfide state before hydrotreating in order to increase the catalytic hydrogenation activity of the dual catalyst system. Therefore, the catalytic hydrogenation activity of the dual catalyst system can be maintained for a long time if the fuel that is to be hydrotreated contains a small amount of sulfur containing species. This characteristic of the sulfided CoMo/NiMo dual catalyst system is different from that of the nickel or palladium metallic catalyst used for hydrogenation of the sulfur-free feedstock, such as the chemically synthesized DHDCPD to THDCPD. The hydrogenation catalyst for long-term use is required because the hydrogenation of pygas is typically carried out in a fixed bed reactor in continuous operation mode. However, because the hydrogenation of the high-density liquid hydrocarbons, which are chemically synthesized, is usually carried out in a batch reactor, the hydrogenation catalyst is not required to be used for a long-term period and is not required to resist sulfur poisoning.

A small amount of DCPD is always contained in the $C_5^+$ fractions (the term $C_5^+$ refers to the hydrocarbons containing five or more carbon atoms) obtained as a by-product from naphtha steam cracker for ethylene and propylene production. FIG. 1 shows a typical gas chromatograph of $C_5^+$ fraction of the pygas. FIG. 2 shows a typical gas chromatograph of $C_9^+$ fraction of the pygas. DCPD can be obtained by heat-dimerizing CPD, which is separated from the product stream in a distillation tower. FIG. 3 shows a typical gas chromatograph of $C_9^+$ fraction of the pygas after the first-stage hydrogenation. FIG. 4 shows a typical gas chromatograph of another $C_9^+$ fraction of the pygas after the first-stage hydrogenation. Referring to FIGS. 3 and 4, after the pygas is subjected to the first-stage hydrogenation at low temperature, DHDCPD and THDCPD, which are the hydrotreated products of DCPD, were usually found in the $C_{10}$ fraction. However, the high purity DCPD and its hydrogenated products, namely DHDCPD and THDCPD used as a precursor of JP-10, have not been successfully separated from the other hydrocarbons in the pygas after the hydrogenation so far because there are residual sulfur impurity and a large number of $C_9$-$C_{10}$ aromatic hydrocarbons contained in the pygas, and the $C_9$-$C_{10}$ aromatic hydrocarbons have a similar or identical separation characteristics, such as boiling point, as that of DHDCPD and THDCPD. With the same reasons, the high purity DMCPD and its hydrogenated products, namely DHDMCPD and THDMCPD used as precursors of RJ-4 and RJ-4I, have not been successfully separated from the other hydrocarbons in the pygas after the hydrogenation so far. Likewise, the new high purity $C_{11}$ hydrocarbons as precursors of high energy fuels have not been successfully separated from the other hydrocarbons in the pygas after the hydrogenation so far.

The pygas is not stable because a trace amount of highly reactive impurities, such as alkynes, diolefins, styrene, and methylstyrene, are present in the pygas. In order to stabilize the pygas, partially (the first stage) hydrogenation of $C_5$-$C_8$ fraction having a boiling point below 150° C. was carried out at a temperature of 50 to 110° C., a pressure of 400 to 600 psig $H_2$, a liquid hourly space velocity of 1 to 4, an $H_2$/liquid chargestock mole ratio of 1 to 2, and in the presence of a nickel or palladium catalyst, and alternatively partially hydrogenating the non-aromatic unsaturated moieties of the combination of the $C_5$-$C_{12}$ derivative and the $C_6$-$C_8$ fraction is performed at a temperature of 180 to 250° C., a pressure of 500 to 1000 psig $H_2$, a liquid hourly space velocity of 1 to 2, an $H_2$/liquid chargestock mole ratio of 8 to 12, and in the presence of a sulfided CoMo/NiMo single or dual catalyst system, and thereby the highly reactive components, such as alkynes, diolefins, and the like, in the pygas will be partially converted to alkenes. Furthermore, the $C_5$ alkenes are separated from the alkenes for further use, and subsequently the $C_6$-$C_8$ fraction are separated from $C_5$ alkenes. The second stage hydrogenation of $C_6$-$C_8$ fraction was carried out at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system, so that the aromatic alkenes are converted to the aromatic alkanes, and the sulfur-containing impurities are also removed from the products. Subsequently, $C_6$-$C_8$ aromatic hydrocarbons (such as benzene, toluene, and xylenes) were separated out by distillation or extraction, and were used as petrochemical feedstocks. Because a small amount of $C_9$-$C_{10}$ fraction contained in the pygas has a variety of constituents and has relatively high sulfur content, its stability is too low to be used. If the $C_9$-$C_{10}$ fraction was not hydrotreated or desulfurized, it was usually blended with low-quality gasoline, diesel oil, or kerosene so that its economical benefit is low. FIG. 5 is a block flow diagram of a sequence of steps for preparing $C_6$-$C_8$ aromatic hydrocarbons, $C_9^+$ aromatic hydrocarbons, crude fuel oil, and $C_9$ resin at naphtha steam cracker. The $C_4^-$ gas fraction is separated from the pygas by distillation. The pygas stream routed from steam cracker was proceeded to a depentanizer (V-11) to separate a $C_5$ fraction from the other hydrocarbons, followed by proceeding to a deoctanizer (V-12) to separate an unhydrotreated $C_9^+$ bottoms from the pygas stream, and followed by proceeding to a denonanizer (V-13) to separate a overhead oil used as resin raw material from a bottoms as fuel. After the overheads obtained in the deoctanizer (V-12) was mixed with unhydrotreated $C_5$ hydrocarbons, the diolefins and styrene contained in the mixture was selectively hydrogenated at the first-stage hydrogenation plant (R-11), followed by proceeding to a downstream depentanizer (V-21) to separate $C_5$ olefins to be used as a feedstock for producing tert-amyl methyl ether. The $C_6$-$C_8$ and $C_9^+$ fractions were separated out from the $C_5$ overheads of V-21 in the downstream deoctanizer (V-22). The $C_6$-$C_8$ fraction as V22 overheads was hydrotreated at the second-stage hydrogenation plant (R-21), followed by proceeding to a depentanizer (V-23) to recover the bottoms containing the $C_6$-$C_8$ aromatic hydrocarbons. Then, the bottoms containing the $C_6$-$C_8$ aromatic hydrocarbons were subjected to the separation followed by conversion to produce the petrochemical products. The $C_9^+$ fraction obtained from the bottoms of V-22 was blended with gasoline in a small proportion.

The unhydrotreated $C_9^+$ oil contained in the pygas stream can be used as the resin raw material, or can be hydrotreated and subsequently blended with gasoline. Either the first-stage hydrotreated $C_9^+$ fraction or the unhydrotreated $C_9^+$ fraction contains a large amount of aromatic hydrocarbons and unsaturated hydrocarbons that are detrimental to the quality of the fuels. However, the $C_9^+$ fraction is not suitable to be blended with gasoline according to the environmental regulation issued nowadays.

The cost for preparing the high energy fuels, such as JP-10, RJ-4, and RJ-4I, mainly depends on the cost of the chemical synthesis of the extra-high purity precursors of the $C_{10}$ compounds, such as DCPD, DHDCPD, and THDCPD, or mainly depends on the cost of the chemical synthesis of the extra-high purity precursors of the $C_{12}$ compounds, such as DMCPD, DHDMCPD, and THDMCPD. However, the cost of the chemical synthesis of the extra-high purity precursors of the $C_{10}$ compounds or the $C_{12}$ compounds is very high. Therefore, how to prepare the high energy fuels (such as JP-10, RJ-4, and RJ-4I) at cheap price becomes an important issue.

SUMMARY OF THE INVENTION

Accordingly, the objective of the present invention is to provide a method for preparing the high energy fuels having the similar properties as JP-10, RJ-4, and RJ-4I from pygas at cheap price.

To achieve the foregoing objective, the present invention provides a method for preparing the high energy fuels from pygas. In this method, the petrochemical products of the $C_5$ olefins and $C_6$-$C_9$ aromatic hydrocarbons along with the extra high purity (>90%) of $C_{10}^+$ non-aromatics which can be converted to the high energy fuels having the similar properties as JP-10, RJ-4, and RJ-4I by isomerization are produced. The method for preparing the high energy fuels according to the present invention comprises the following steps: a) providing a pyrolysis gasoline; b) distilling the pyrolysis gasoline to separate a $C_5$ fraction from a $C_6$ and heavier fraction; c) distilling the $C_6$ and heavier fraction to separate a $C_6$-$C_8$ fraction from a $C_9$ and heavier fraction; d) heat soaking the $C_5$ fraction to form a $C_5$-$C_{12}$ derivative; e) combining the $C_5$-$C_{12}$ derivative with the $C_6$-$C_8$ fraction; f) partially hydrogenating non-aromatic unsaturated moieties of the combination of the $C_5$-$C_{12}$ derivative and the $C_6$-$C_8$ fraction to form a first-stage hydrogenated mixture; g) distilling the first-stage hydrogenated mixture to separate a first-stage hydrogenated $C_5$ fraction, which is used as a petrochemical feedstock, from a first-stage hydrogenated $C_6$-$C_{12}$ fraction; h) selectively hydrogenating the remaining non-aromatic unsaturated moieties of the first-stage hydrogenated $C_6$-$C_{12}$ fraction to form a second-stage hydrogenated mixture; i) distilling the second-stage hydrogenated mixture to separate out a $C_6$-$C_9$ aromatic hydrocarbon fraction as a petrochemical product, a $C_{10}$-$C_{12}$ non-aromatic hydrocarbon fraction (endo isomer) as a precursor of a high energy fuel, and a fraction having a boiling point higher than a boiling point of the $C_{10}$-$C_{12}$ non-aromatic hydrocarbon fraction as a bottoms; and j) isomerizing the $C_{10}$-$C_{12}$ non-aromatic hydrocarbon fraction (endo isomer) as a precursor of a high energy fuel to a $C_{10}$-$C_{12}$ hydrocarbon fraction (exo isomer) as a high energy fuel in the presence of acidic catalyst. Furthermore, the order of step c) and step d) mentioned above can be exchanged. Moreover, in order to increase the amount of DCPD, CPD/MCPD codimers, and DMCPD upon heat soaking in the above-mentioned step d), the pygas can be fed to a dehexanizer to separate a $C_5$-$C_6$ fraction as a first overheads from a heavier fraction instead of being fed to a first depentanizer to separate a $C_5$ fraction as a first overheads in the above-mentioned step b).

In another aspect, the present invention provides a method for preparing the high energy fuels from pygas, which comprises the following steps: a) providing a pyrolysis gasoline; b) distilling the pyrolysis gasoline to separate a $C_5$ fraction from a $C_6$ and heavier fraction; c) distilling the $C_6$ and heavier fraction to separate a $C_6$-$C_8$ fraction from a $C_9$ and heavier fraction; d) heat soaking the $C_5$ fraction to form a $C_5$-$C_{12}$ derivative; e) combining the $C_5$-$C_{12}$ derivative with the $C_6$-$C_8$ fraction; f) partially hydrogenating non-aromatic unsaturated moieties of the combination of the $C_5$-$C_{12}$ derivative and the $C_6$-$C_8$ fraction to form a first-stage hydrogenated mixture; g) distilling the first-stage hydrogenated mixture to separate a first-stage hydrogenated $C_5$ fraction, which is used as a petrochemical feedstock, from a first-stage hydrogenated $C_6$-$C_{12}$ fraction; h) selectively hydrogenating the remaining non-aromatic unsaturated moieties of the first-stage hydrogenated $C_6$-$C_{12}$ fraction to form a second-stage hydrogenated mixture; i) distilling the second-stage hydrogenated mixture to separate out a $C_6$-$C_8$ aromatic hydrocarbon fraction as a petrochemical product, a $C_{10}$-$C_{12}$ non-aromatic hydrocarbon fraction (endo isomer) as a precursor of a high energy fuel, and a fraction having a boiling point higher than a boiling point of the $C_{10}$-$C_{12}$ non-aromatic hydrocarbon fraction as a bottoms; j) isolating endo-tetrahydrodicyclopentadiene from the $C_{10}$-$C_{12}$ non-aromatic hydrocarbon fraction (endo isomer) as a precursor of a high energy fuel by a first crystallization under a first low temperature; k) isolating a $C_{10}$-$C_{12}$ non-aromatic hydrocarbon fraction (endo isomer) as a precursor of a high energy fuel from a filtrate separated from the first crystallization by a second crystallization under a second low temperature; l) isomerizing endo-tetrahydrodicyclopentadiene to exo-tetrahydrodicyclopentadiene as a high energy fuel in the presence of acidic catalyst.; and m) isomerizing the $C_{10}$-$C_{12}$ non-aromatic hydrocarbon fraction (endo isomer) as a precursor of a high energy fuel to a $C_{10}$-$C_{12}$ non-aromatic hydrocarbon fraction (exo isomer) as a high energy fuel in the presence of acidic catalyst. Furthermore, the order of step c) and step d) mentioned above can be exchanged. Moreover, in order to increase the amount of DCPD, CPD/MCPD codimers, and DMCPD upon heat soaking in the above-mentioned step d), the pygas can be fed to a dehexanizer to separate a $C_5$-$C_6$ fraction as a first overheads from a heavier fraction instead of being fed to a first depentanizer to separate a $C_5$ fraction as a first overheads in the above-mentioned step b).

According to the present invention, a series of high density, high energy, low viscosity non-aromatic $C_{10}^+$ hydrocarbon fuels can be manufactured in more economical ways than ever before. Therefore, the high energy fuels can be used as the aviation or jet fuels in the near future. Furthermore, according to the present invention, many $C_{11}$ hydrocarbons having the molecular structures similar to those of JP-10, RJ-4, and RJ-4I are also produced. However, although these $C_{11}$ hydrocarbon compounds can be used as high energy fuels as indicated in U.S. Pat. No. 4,107,223, they have never been synthesized to be used as high energy fuels. However, according to the present invention, these $C_{11}$ hydrocarbons used as high energy fuels along with other well-known high energy fuels can be economically produced from pygas which is a by-product of ethylene manufacture.

The foregoing and other objects, features, aspects and advantages of the present invention will become better understood from a careful reading of a detailed description provided herein below with appropriate reference to the accompanying block flow diagrams.

DETAILED DESCRIPTION OF THE PREFERRED EMBODIMENTS

The following descriptions are exemplary embodiments only, and are not intended to limit the scope or applicability of the present invention in any way. Rather, the following description provides a convenient illustration for implementing exemplary embodiments of the present invention.

Figure 7:
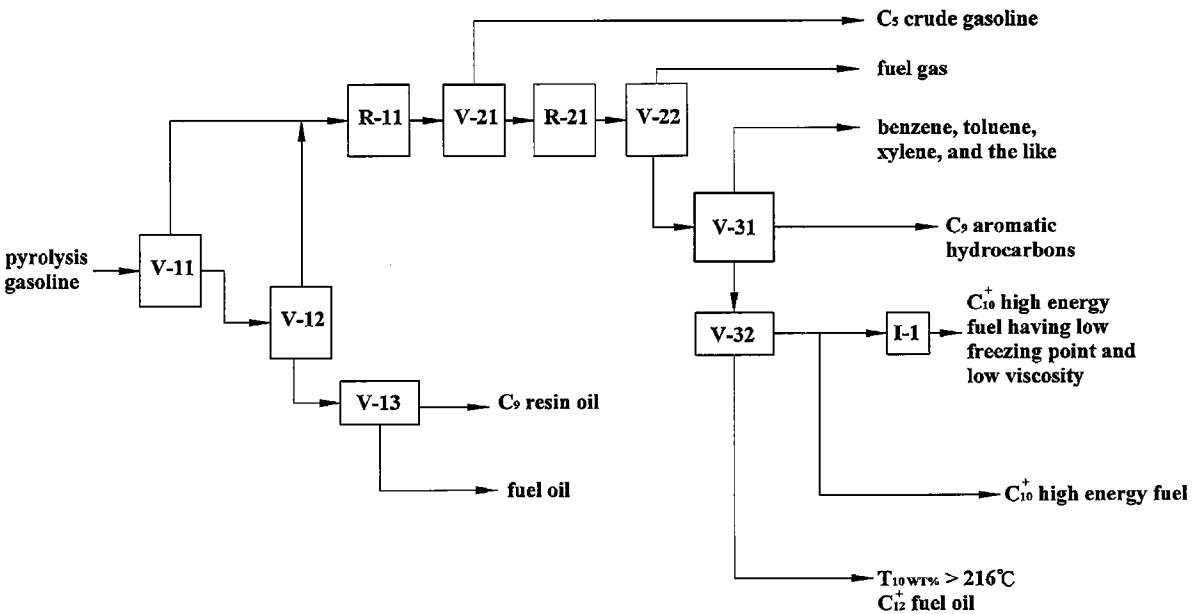
FIG. 7 is a block flow diagram of a sequence of steps for preparing two streams of $C_{10}$-$C_{12}$ high energy fuels from pygas in accordance with the second embodiment of present invention.

The examples for preparing $C_6$-$C_8$ aromatic hydrocarbons used as petrochemical products, and $C_{10}$-$C_{12}$ non-aromatic hydrocarbons used as high energy fuels will be described in the following. FIG. 7 is a block flow diagram of a sequence of steps for preparing two streams of $C_{10}$-$C_{12}$ high energy fuels from pygas in accordance with the second embodiment of present invention Referring to FIG. 7, the pygas by-product from naphtha steam cracker is used as feedstock. Then, the pygas is fed to a depentanizer (V-11) to separate a $C_5$ fraction as a first overheads from a $C_6$ and heavier fraction as a first bottoms. Thereafter, the first overheads, namely $C_5$ fraction, is heat soaked to form the $C_5$-$C_{12}$ derivatives. Then, the first bottoms is fed to a downstream deoctanizer (V-12) to separate a second overheads having 90 wt. % recovered temperature ($T_{90\ wt\ \%}$) ranging from 135 to 165° C. as determined by ASTM Method D2887 (standard test method for boiling range distribution of petroleum fractions) from a C9 and heavier fraction as a second bottoms. Afterwards, the second overheads from the deoctanizer (V-12) is mixed with the $C_5$-$C_{12}$ derivatives obtained from heat soaking of $C_5$ fraction and fed into the first stage hydrotreating reactor wherein the non-aromatic unsaturated moieties of the mixture (such as vinyl group in styrene) are partially hydrogenated. Then, the hydrogenated mixture is fed to a downstream depentanizer to separate a $C_5$ olefin fraction as a second overheads, which is used as a petrochemical feedstock, from a $C_6$-$C_{12}$ fraction as a second bottoms. Subsequently, the $C_6$-$C_{12}$ fraction is fed to the second-stage hydrotreating reactor wherein the non-aromatic unsaturated moieties of the $C_6$-$C_{12}$ fraction are selectively hydrogenated and fed to a distillation column reactor to separate out an aromatic $C_6$-$C_9$ hydrocarbon fraction having 90 wt % recovered temperature ranging from 174 to 179° C. as determined by ASTM Method D2887 (used as a petrochemical product), a non-aromatic $C_{10}$-$C_{12}$ fraction having 10 wt % recovered temperature ($T_{10\ wt\ \%}$) ranging from 181 to 186° C. and having 90wt % recovered temperature ranging from 210 to 216° C. as determined by ASTM Method D2887 (used as a precursor of a high energy fuel), and a third bottoms having 10 wt % recovered temperature of >216° C. Then, the non-aromatic $C_{10}$-$C_{12}$ fraction as a precursor of a high energy fuel is isomerized to a liquid high energy fuel in the presence of acidic catalyst, and the produced liquid high energy fuel has a volumetric heating value of more than 39.1 MJ/L, a flash point of higher than 62° C., a viscosity of less than 18 centistokes (cSt) at −20° C., a freezing point of lower than −50° C., a density of more than 0.928 at 15° C., and a sulfur content of less than 5 ppm.

The above-mentioned first overheads from the depentanizer, namely $C_5$ fraction, is heat soaked at 100 to 120° C. for 20 minutes to 2 hours in order to form the $C_5$-$C_{12}$ derivatives. Then, the $C_5$-$C_{12}$ derivatives are cooled down to 40 to 100° C. Afterwards, the $C_5$-$C_{12}$ derivatives obtained from heat soaking of $C_5$ fraction is mixed with the second overheads from the deoctanizer (V-12) and fed into the first stage hydrotreating reactor, and thereby the amount of dicyclopentadiene (DCPD) in the fuel feedstock will increase.

Moreover, in order to increase the amount of DCPD, CPD/MCPD codimers, and DMCPD in the fuel feedstock, the pygas can be fed to a dehexanizer to separate a $C_5$-$C_6$ fraction as a first overheads from a heavier fraction instead of being fed to a first depentanizer to separate a $C_5$ fraction as a first overheads. In this case, the non-aromatic $C_{10}$-$C_{12}$ fraction as a high energy fuel has a volumetric heating value of more than 39.0 MJ/L, a flash point of higher than 63° C., a viscosity of less than 19 cSt at −20° C., a freezing point of lower than 48° C., a density of more than 0.925 at 15° C., and a sulfur content of less than 5 ppm.

Figure 1:
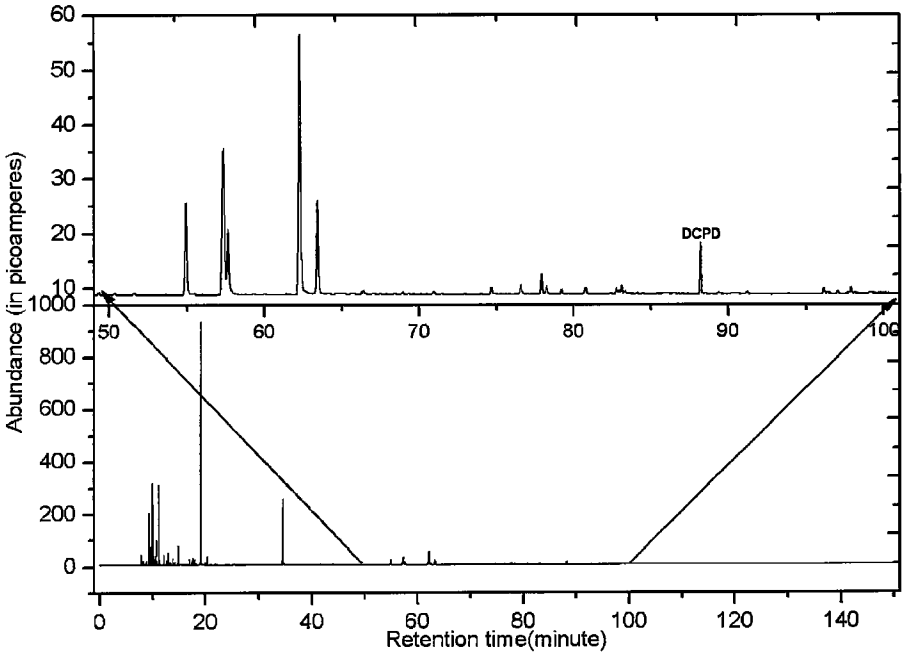
FIG. 1 ( Prior Art )
FIG. 1 shows a typical gas chromatograph of $C_5^+$ fraction of the pygas.
Figure 2:
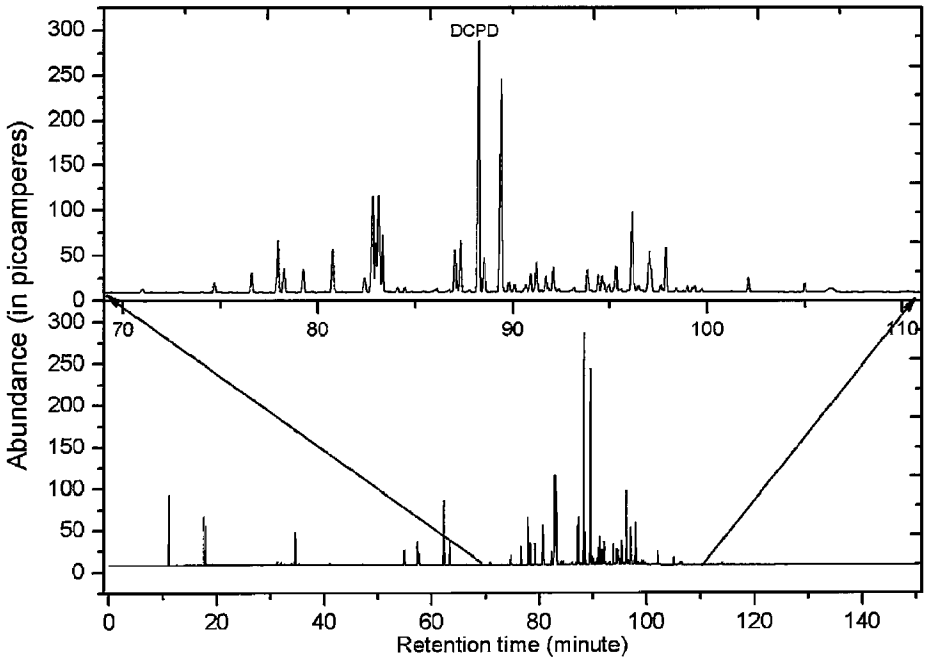
FIG. 2 ( Prior Art )
FIG. 2 shows a typical gas chromatograph of $C_9^+$ fraction of the pygas.
Figure 3:
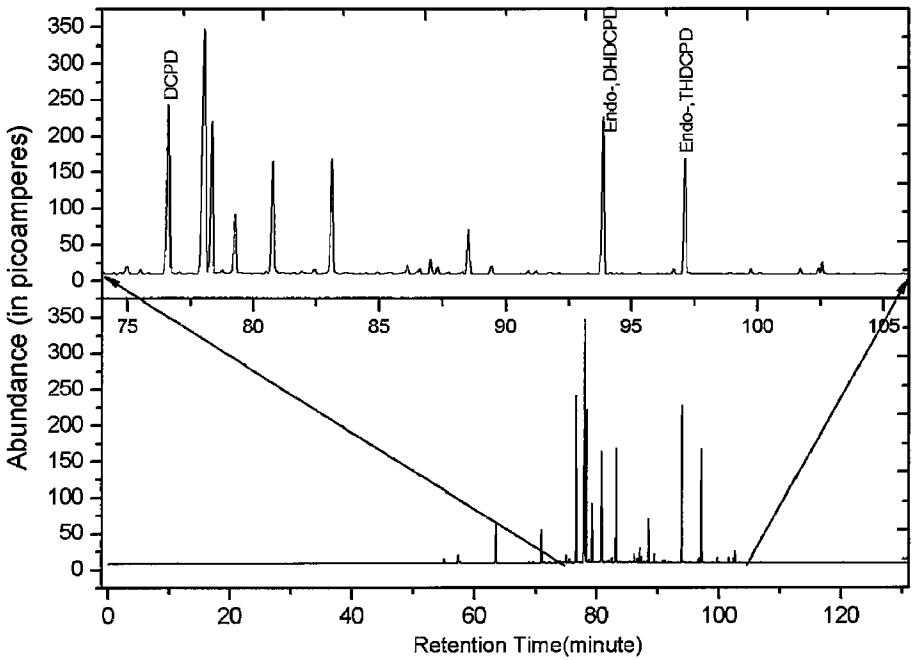
FIG. 3 ( Prior Art )
FIG. 3 shows a typical gas chromatograph of $C_9^+$ fraction of the pygas after the first-stage hydrogenation.
Figure 4:
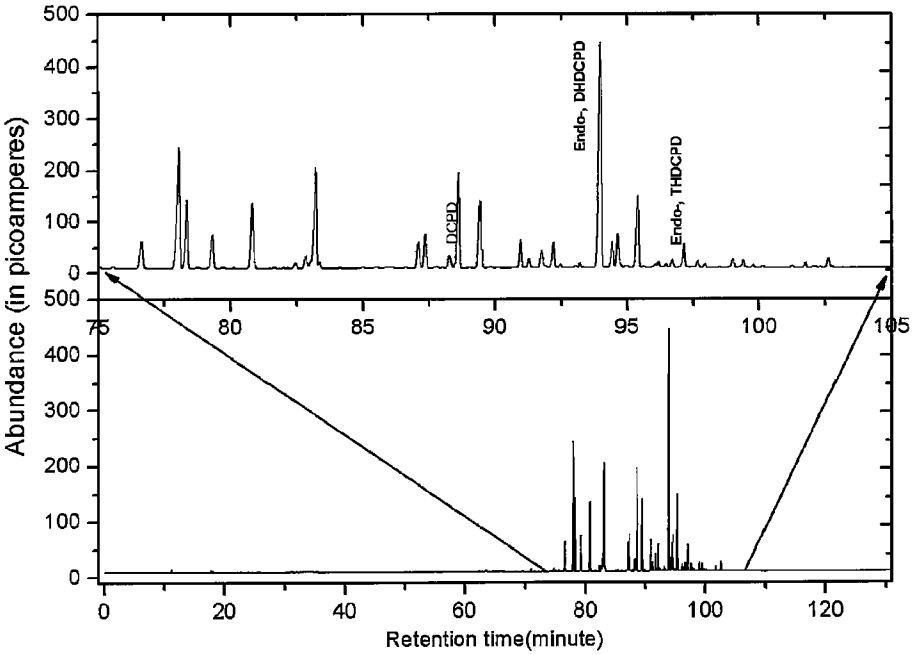
FIG. 4 ( Prior Art )
FIG. 4 shows a typical gas chromatograph of another $C_9^+$ fraction of the pygas after the first-stage hydrogenation.
Figure 5:
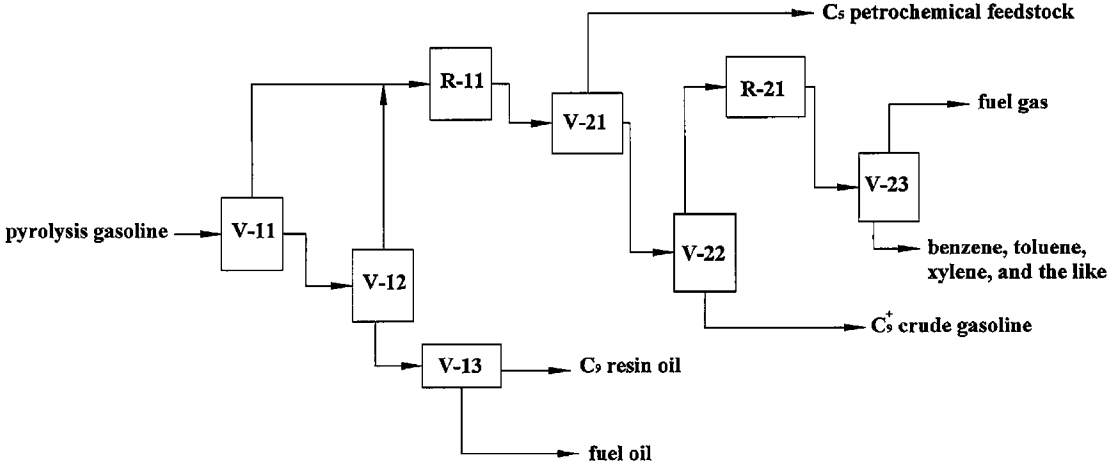
FIG. 5 ( Prior Art )
FIG. 5 is a block flow diagram of a sequence of steps for preparing $C_6$-$C_8$ aromatic hydrocarbons, $C_9^+$ aromatic hydrocarbons, crude fuel oil and $C_9$ resin at naphtha steam cracker in accordance with the prior art.
Figure 6:
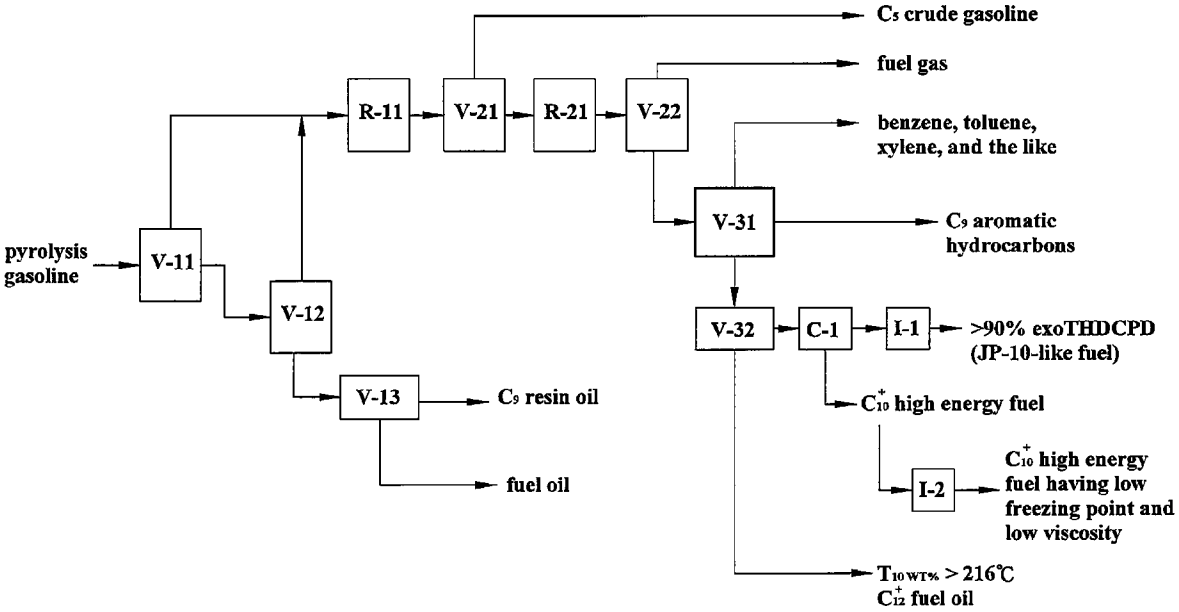
FIG. 6 is a block flow diagram of a sequence of steps for preparing JP-10-like missile fuel and two streams of $C_{10}$-$C_{12}$ high energy fuels from pygas in accordance with the first embodiment of present invention.

FIG. 6 is a block flow diagram of a sequence of steps for preparing JP-10-like missile fuel and two streams of $C_{10}$-$C_{12}$ high energy fuels from pygas in accordance with the first embodiment of present invention. Referring to FIG. 6, the pygas by-product from naphtha steam cracker is used as feedstock. Then, the pygas is fed to a depentanizer (V-11) to separate a $C_5$ fraction as a first overheads from a $C_6$ and heavier fraction as a first bottoms. Thereafter, the first overheads, namely $C_5$ fraction, is heat soaked to form the $C_5$-$C_{12}$ derivatives. Then, the first bottoms is fed to a downstream deoctanizer (V-12) to separate a second overheads having 90 wt % recovered temperature ranging from 135 to 165° C. as determined by ASTM Method D2887 from a $C_9$ and heavier fraction as a second bottoms. Afterwards, the second overheads from the deoctanizer (V-12) is mixed with the $C_5$-$C_{12}$ derivatives obtained from heat soaking of $C_5$ fraction and fed into the first stage hydrotreating reactor wherein diolefins and styrene contained within the mixture are selectively hydrogenated. Then, the hydrogenated mixture is fed to a downstream depentanizer to separate a $C_5$ olefin fraction as a second overheads, which is used as a petrochemical feedstock, from a $C_6$ and heavier fraction as a second bottoms. Subsequently, the $C_6$ and heavier fraction is fed to the second-stage hydrotreating reactor wherein olefinic moieties contained within the $C_6$ and heavier fraction are selectively hydrogenated and fed to a distillation column reactor to separate out an aromatic $C_6$-$C_9$ hydrocarbon fraction having 90 wt % recovered temperature ranging from 174 to 179° C. as determined by ASTM Method D2887 (used as a petrochemical product), a non-aromatic $C_{10}$ and heavier hydrocarbon fraction having 10 wt % recovered temperature ranging from 181 to 186° C. and having 90 wt % recovered temperature ranging from 210 to 216° C. as determined by ASTM Method D2887 (used as a precursor of a high energy fuel), and a third bottoms having 10 wt % recovered temperature of >216° C. Then, endo-tetrahydrodicyclopentadiene with the purity of more than 90% is acquired by crystallizing the non-aromatic $C_{10}$ and heavier hydrocarbon fraction as a precursor of a high energy fuel at 40 to −25° C., preferably at −5 to −25° C., followed by dissolving endo-tetrahydrodicyclopentadiene in an appropriate solvent. Then, endo-tetrahydrodicyclopentadiene is isomerized to exo-tetrahydrodicyclopentadiene (>90 wt %) as a missile fuel along with adamantane (<1 wt %) in the presence of acidic catalyst. Exo-tetrahydrodicyclopentadiene has a volumetric heating value of more than 39.0 MJ/L, a flash point of higher than 55° C., a viscosity of less than 15 centistokes (cSt) at −54° C., a freezing point of lower than −55° C., a density of more than 0.931 at 15° C., and a sulfur content of less than 5 ppm. The remaining filtrate from crystallization of endo-tetrahydrodicyclopentadiene is crystallized to obtain a non-aromatic $C_{10}$-$C_{12}$ hydrocarbons as precursors of high energy fuels at the temperature ranging from 40 to −25° C., preferably at the temperature ranging from −5 to −25° C., and then the non-aromatic $C_{10}$-$C_{12}$ hydrocarbons as precursors of high energy fuels is isomerized to exo-isomers as high energy fuels in the presence of acidic catalyst. The exo-isomers as high energy fuels have a volumetric heating value of more than 38.7 MJ/L, a flash point of higher than 64° C., a viscosity of less than 20 cSt at −20° C., a freezing point of lower than −65° C., a density of more than 0.918 at 15° C., and a sulfur content of less than 5 ppm.

The above-mentioned first overheads from the depentanizer, namely $C_5$ fraction, is heat soaked at 100 to 120° C. for 20 minutes to 2 hours in order to form the $C_5$-$C_{12}$ derivatives. Then, the $C_5$-$C_{12}$ derivatives are cooled down to the temperature of 40 to 100° C. Afterwards, the $C_5$-$C_{12}$ derivatives obtained from heat soaking of $C_5$ fraction is mixed with the second overheads from the deoctanizer (V-12) and fed into the first stage hydrotreating reactor, and thereby the amount of dicyclopentadiene (DCPD) in the fuel feedstock will increase.

Moreover, in order to increase the amount of DCPD, CPD/MCPD codimers, and DMCPD in the fuel feedstock, the pygas can be fed to a dehexanizer to separate a $C_5$-$C_6$ fraction as a first overheads from a heavier fraction instead of being fed to a depentanizer to separate a $C_5$ fraction as a first overheads from a heavier fraction. The $C_5$-$C_6$ fraction is heat soaked at 100-120° C. for 20 minutes to 2 hours, subsequently cooling to 40-100° C., and then adding to the pre-heated fuel feedstock, which is to be fed to the first-stage hydrotreating reactor. In this case, the $C_{10}$-$C_{12}$ non-aromatic hydrocarbon fraction obtained as a high energy fuel has a volumetric heating value of more than 38.5 MJ/L, a flash point of higher than 65° C., a viscosity of less than 22 cSt at −20° C., a freezing point of lower than −60° C., a density of more than 0.915 at 15° C., and a sulfur content of less than 5 ppm.

The catalytic activity of nickel or palladium-containing catalyst for partially hydrogenation used in the first-stage hydrotreating reactor is adjusted in such a manner that the amount of DCPD present in the feedstock to the second-stage hydrotreating reactor is less than 6 wt %. Preferably, the catalytic activity of nickel or palladium-containing catalyst for selective hydrogenation used in the first-stage hydrotreating reactor is adjusted in such a manner that the amount of DCPD present in the feedstock to the second-stage hydrotreating reactor is less than 3 wt %. More preferably, the catalytic activity of nickel or palladium-containing catalyst for selective hydrogenation used in the first-stage hydrotreating reactor is adjusted in such a manner that the amount of DCPD present in the feedstock to the second-stage hydrotreating reactor is less them 1 wt %. Moreover, the catalytic activity of the sulfided CoMo/NiMo dual catalyst system used in the second-stage hydrotreating reactor is adjusted in such a manner that the amount of sulfur present in the liquid hydrogenated product is less than 5 ppm. Preferably, the catalytic activity of the sulfided CoMo/NiMo dual catalyst system used in the second-stage hydrotreating reactor is adjusted in such a manner that the amount of sulfur present in the liquid hydrogenated product is less than 2 ppm.

The pygas, which has 90 wt % recovered temperature ranging from 135 to 175° C. as determined by ASTM Method D2887, separated out from the distillation column reactor at naphtha steam cracker is used as feedstock. The $C_6$ and heavier fraction, which is the first-stage hydrogenated product, is fed to the second-stage hydrotreating reactor. Then, the second-stage hydrogenated $C_6$ and heavier fraction is fed to a distillation column reactor to separate out the following four fractions: (1) the overheads mainly containing $C_6$-$C_8$ aromatic hydrocarbons and having 90 wt % recovered temperature of lower than 150° C. as determined by ASTM Method D2887; (2) the $C_9$ fraction having 10 wt % recovered temperature ranging from 145 to 155° C. and having 90 wt % recovered temperature ranging from 180 to 190° C. as determined by ASTM Method D2887; (3) the fuel fraction mainly containing $C_{10}^+$ non-aromatics of dimers or codimers of CPD and MCPD, which has 10 wt % recovered temperature ranging from 180 to 190° C. and has 90 wt % recovered temperature ranging from 210 to 220° C. as determined by ASTM Method D2887; and (4) the $C_{12}^+$ bottoms having 10 wt % recovered temperature of higher than 216° C. Without changing the existing petroleum refining process, the above fuel fraction (3) is fed to a downstream small-volume crystallization reactor, followed by undergoing a low-temperature treatment (40 to 25° C.) for 10 minutes to 1 hour, and the fully saturated, hydrogenated $C_{10}$-$C_{12}$ endo-dimers (mainly containing endo-THDCPD) with relatively high freezing point is crystallized and filtered off. Subsequently, the crystals of the fully saturated, hydrogenated $C_{10}$-$C_{12}$ endo-dimers as precursors of high energy fuels are melted or dissolved in a solvent and then placed into a small-volume isomerization reactor, followed by isomerizing them in the presence of an acidic catalyst to give more than 90 wt % of the liquid $C_{10}$-$C_{12}$ exo-dimers as high energy fuels using the same working conditions for isomerization as those described in U.S. Pat. Nos. 4,086,284, 4,107,223, and 4,270,014. Consequently, a stream of a JP-10-like high energy fuel is cheaply manufactured from pygas by-product from naphtha steam cracker. Furthermore, the high-density $C_{10}^+$ filtrate after filtering off the crystals of the fully saturated and hydrogenated $C_{10}$-$C_{12}$ endo-dimers is isomerized to another stream of new $C_{11}$-$C_{12}$ high energy fuels having the properties between JP-10 and RJ-4I in the presence of an acidic catalyst.

Alternatively, the above fuel fraction (3) is not subjected to crystallization and is directly isomerized to another stream of $C_{10}$-$C_{12}$ high energy fuels having the properties between JP-10 and RJ-4I in the presence of an acidic catalyst.

Conventionally, endo-THDCPD and endo-THDMCPD obtained by chemical synthesis are respectively isomerized to exo-THDCPD and exo-THDMCPD using $AlCl_3$ or sulfuric acid as an acidic catalyst in order to prepare JP-10, RJ-4, and RJ-4I which are used as liquid missile fuels, as described in U.S. Pat. Nos. 3,381,046, 4,086,284, 4,107,223, 4,177,217, 4,270,014, 4,288,644, and 4,398,978. In the present invention, $C_{10}^+$ hydrocarbons as a precursor of a high energy fuel is also isomerized to the $C_{10}^+$ hydrocarbons as a high energy fuel in the presence of an acidic catalyst as the acid catalytic isomerization of the chemically synthetic $C_{10}^+$ hydrocarbons as a precursor of a high energy fuel described in the prior art. The isomerization conditions, reactors, and equipments described in the prior art, such as in U.S. Pat. Nos. 3,381,046, 4,086,284, 4,107,223, 4,177,217, 4,270,014, 4,288,644, and 4,398,978, are suitably applied to the acid catalytic isomerization of the $C_{10}^+$ hydrocarbons as a precursor of a high energy fuel prepared from pygas to the $C_{10}^+$ hydrocarbons as a high energy fuel in the present invention. However, the isomerization conditions can be properly controlled to avoid the production of the unwanted side products, such as adamantane, or low-density decalin by ring-opening of the polycyclic hydrocarbons after the vigorous reaction.

Therefore, according to the above description, the method for preparing high energy fuels of the present invention comprises the following steps: a) a pyrolysis gasoline is provided; b) the pyrolysis gasoline is fed to a first depentanizer to separate a $C_5$ fraction as a first overheads from a $C_6$ and heavier fraction as a first bottoms; c) the $C_6$ and heavier fraction is fed to a first deoctanizer to separate a $C_6$-$C_8$ fraction as a second overheads from a $C_6$ and heavier fraction as a second bottoms; d) the first overheads from step a) is heat soaked to form a $C_5$-$C_{12}$ derivative; e) the $C_6$-$C_8$ fraction as a second overheads from step c) and the $C_5$-$C_{12}$ derivative from step d) are combined and fed to a first-stage hydrotreater reactor wherein the non-aromatic unsaturated moieties of the $C_6$-$C_{12}$ derivative and the $C_6$-$C_8$ fraction (such as the vinyl group in styrene) are partially hydrogenated concurrently with the formation of a first-stage hydrogenated $C_5$-$C_{12}$ mixture; f) the first $C_5$-$C_{12}$ mixture from step e) is fed to a second depentanizer to separate a $C_5$ olefin fraction as a third overheads, which is used as a petrochemical raw material, from a $C_6$-$C_{12}$ fraction as a third bottoms; g) the $C_6$-$C_{12}$ fraction from step f) is fed to a second-stage hydrotreater reactor wherein the remaining non-aromatic unsaturated moieties of the first-stage hydrogenated $C_6$-$C_{12}$ fraction are selectively hydrogenated concurrently with the formation of a second-stage hydrogenated mixture; h) the second-stage hydrogenated mixture from step g) is fed to a distillation column reactor to separate out an aromatic $C_6$-$C_9$ hydrocarbon fraction as a petrochemical product, a non-aromatic $C_{10}$-$C_{12}$ fraction (endo isomer) as a precursor of a high energy fuel, and a fourth bottoms as fuel oil having a boiling point higher than a boiling point of the non-aromatic $C_{10}$-$C_{12}$ fraction (endo isomer); and i) the non-aromatic $C_{10}$-$C_{12}$ fraction (endo isomer) as a precursor of a high energy fuel is isomerized to a non-aromatic $C_{10}$-$C_{12}$ fraction (exo isomer) as a high energy fuel in the presence of acidic catalyst. Furthermore, the order of stop c) and step d) mentioned above can be exchanged. Moreover, in order to increase the amount of DCPD, CPD/MCPD co-dimers and DMCPD upon heat-soaking in the above-mentioned step d), the pyrolysis gasoline can be fed to a first dehexanizer to separate a $C_5$-$C_6$ fraction as a first overheads from a heavier fraction instead of being fed to a first depentanizer to separate a $C_5$ fraction as a first overheads in the above-mentioned step b).

In another aspect, according to the above description, the method for preparing the high energy fuels of the present invention comprises the following steps: a) a pyrolysis gasoline is provided; b) the pyrolysis gasoline is fed to a first depentanizer to separate a $C_5$ fraction as a first overheads from a $C_6$ and heavier fraction as a first bottoms; c) the $C_6$ and heavier fraction is fed to a first deoctanizer to separate a $C_6$-$C_8$ fraction as a second overheads from a $C_9$ and heavier fraction as a second bottoms; d) the first overheads from step a) is heat soaked to form a $C_5$-$C_{12}$ derivative; e) the $C_6$-$C_8$ fraction as a second overheads from step c) and the $C_5$-$C_{12}$ derivative from step d) are combined and fed to a first-stage hydrotreater reactor wherein the non-aromatic unsaturated moieties of the $C_6$-$C_8$ fraction (such as the vinyl group in styrene) and the $C_5$-$C_{12}$ derivative are partially hydrogenated concurrently with the formation of a first-stage hydrogenated $C_5$-$C_{12}$ mixture; f) the first $C_5$-$C_{12}$ mixture from step d) is fed to a second depentanizer to separate a $C_5$ olefin fraction as a third overheads, which is used as a petrochemical feedstock, from a $C_6$-$C_{12}$ fraction as a third bottoms; g) the $C_6$-$C_{12}$ fraction from step f) is fed to a second-stage hydrotreater reactor wherein the remaining non-aromatic unsaturated moieties of the $C_6$-$C_{12}$ fraction are selectively hydrogenated concurrently with the formation of a second-stage hydrogenated mixture; h) the second-stage hydrogenated mixture from step g) is fed to a distillation column reactor to separate out an aromatic $C_6$-$C_9$ hydrocarbon fraction as a petrochemical product, a $C_{10}$-$C_{12}$ non-aromatic hydrocarbon fraction (endo isomer) as a precursor of a high energy fuel, and a third bottoms as a fuel oil having a boiling point higher than a boiling point of the $C_{10}$-$C_{12}$ non-aromatic hydrocarbon fraction (endo isomer); i) endo-tetrahydrodicyclopentadiene is isolated from the $C_{10}$-$C_{12}$ non-aromatic hydrocarbon fraction as a precursor of a high energy fuel by crystallization, and a remaining filtrate from the above crystallization is crystallized to obtain a $C_{10}$-$C_{12}$ non-aromatic hydrocarbon fraction (endo isomer) as precursors of high energy fuels; j) endo-tetrahydrodicyclopentadiene is isomerized to exo-tetrahydrodicyclopentadiene as a missile fuel in the presence of acidic catalyst; and k) the $C_{10}$-$C_{12}$ non-aromatic hydrocarbon fraction (endo isomer) as a precursor of a high energy fuel is isomerized to a $C_{10}$-$C_{12}$ non-aromatic hydrocarbons (exo isomer) as a high energy fuel in the presence of acidic catalyst. Furthermore, the order of step c) and step d) mentioned above can be exchanged. Moreover, in order to increase the amount of DCPD, CPD/MCPD co-dimers and DMCPD upon heat-soaking in the above-mentioned step d), the pyrolysis gasoline can be fed to a first dehexanizer to separate a $C_5$-$C_6$ fraction as a first overheads from a heavier fraction instead of being fed to a first depentanizer to separate a C 5 fraction as a first overheads in the above-mentioned step b).

In the present invention, the high energy fuels are advantageously prepared from cheap pygas using the conventional petroleum refining process with only minor modification of the process. That is to say, under the fundamentals of the conventional petroleum refining process design, the additional downstream small-volume crystallization reactor and small-volume isomerization reactor are used for aftertreating THDCPD ($C_{10}$ hydrocarbons) and THDCPD-like $C_{11}^+$ hydrocarbons prepared from pygas. In the present invention, the $C_6$-$C_9$ aromatic hydrocarbons useful as the petrochemical products along with the JP-10-like high energy fuels and the $C_{11}$-$C_{12}$ hydrocarbons having the similar chemical structures as JP-10 and being useful as the high energy fuels can be prepared. Furthermore, such cheaply prepared high energy fuels produced in the present invention can be widely use. For example, these high energy fuels can be blended with the jet fuels in the near future.

EXAMPLE 1

The pygas, which has 90 wt % recovered temperature ranging from 160 to 175° C. as determined by ASTM Method D2887, separated out from the distillation column reactor at naphtha steam cracker is used as feedstock. The pygas can be directly hydrotreated at the first-stage hydrogenation plant (R-11) and at the second-stage hydrogenation plant (R-21). Alternatively, as shown in FIG. 6, the heavier pygas is fed to a depentanizer (V-11) to separate out the first overheads having 90 wt % recovered temperature ranging from 135 to 165° C. as determined by ASTM Method D2887. Then, the first overheads is hydrotreated at the first-stage hydrogenation plant (R-11) and at the second-stage hydrogenation plant (R-21). Subsequently, the two-stage hydrotreated product is fed to the downstream deoctanizer (V-22) to separate the second overheads from the second bottoms. Then, the second bottoms is fed to the distillation column reactor (V-31) to separate the third overheads from the third bottoms. Then, the third bottoms is fed to the distillation column reactor (V-32) to separate the fourth overheads from the fourth bottoms. The fourth overheads having 10 wt % recovered temperature ranging from 180 to 190° C. and having 90 wt % recovered temperature ranging from 210 to 220° C. as determined by ASTM Method D2887. The fourth overheads contains more than 90 wt % of CPD and MCPD dimers (i.e. the two-stage hydrotreated and saturated $C_{10}$-$C_{12}$ derivatives). The endo-THDCPD ($C_{10}$) crystals with the purity of more than 90% are acquired by crystallizing the fourth overheads at the temperature ranging from 40 to −25° C. for 10 minutes to 1 hour in crystallization reactor C-1. However, the optimum crystallization conditions depend on the amount of endo-THDCPD ($C_{10}$) present in the fourth overheads. Moreover, the endo-THDCPD ($C_{10}$) crystals are washed with the polar organic solvents such as ethanol to remove the filtrate stuck on these crystals. Alternatively, the endo-THDCPD ($C_{10}$) crystals are preferably recrystallized in the polar organic solvents such as ethanol, which will leave the small amount of endo-THMDCPD ($C_{11}$) and endo-THDMCPD ($C_{12}$), which have much higher freezing points than endo-THDCPD ($C_{10}$), in the polar organic solvents. After the recrystallization, the endo-THDCPD ($C_{10}$) crystals have the purity of more than 98%.

If the two-stage hydrotreated and saturated $C_{10}$-$C_{12}$ derivatives obtained from the distillation column reactor (V-32) contains a large amount of endo-THDCPD ($C_{10}$ hydrocarbons), the large amount of endo-THDCPD crystals will be precipitated at room temperature due to supersaturation of $C_{10}$ hydrocarbons. After the endo-THDCPD crystals are filtered off, the residual endo-THDCPD remained in the $C_{10}$-$C_{12}$ hydrocarbon filtrate can be repeatedly crystallized out of the filtrate at the low temperature (about −25° C.). The thus obtained endo-THDCPD crystals are isomerized to exo-THDCPD with the purity of more than 90% in the presence of acidic catalyst (such as $AlCl_3$) in the isomerization reactor I-1 according to the acid catalytic isomerization process described in the prior art. When the high purity exo-THDCPD is used as a missile fuel, the properties of exo-THDCPD are very similar to those of JP-10 prepared from multi-step chemical synthesis.

The $C_{10}^+$ filtrate from crystallization reactor C-1 has the properties between JP-10 and RJ-4 and can be also used as a missile fuel. The $C_{10}^+$ filtrate mainly contains exo-THDCPD ($C_{10}$ hydrocarbons), and monomethyl- or dimethyl-substituted endo-THDCPD ($C_{11}$-$C_{12}$ hydrocarbons) with relatively lower freezing points than that of endo-THDCPD, and is a new high energy fuel. If the endo-isomers of $C_{11}^+$ hydrocarbon present in the $C_{10}^+$ filtrate are isomerized to the exo-isomers in the presence of acidic catalyst in the isomerization reactor I-2 (referring to FIG. 6), the freezing point and the viscosity of the new high energy fuel will be decreased.

EXAMPLE 2

The pygas as described in EXAMPLE 1 above is used as feedstock. As shown in the block flow diagram of FIG. 7, the overheads containing CPD and MCPD dimers (i.e. the two-stage hydrotreated and saturated $C_{10}^+$ derivatives) with the purity of more than 90% obtained from the distillation column reactor (V-32) can be directly used as a high energy fuel with the relatively high freezing point if the amount of the $C_{11}$-$C_{12}$ hydrocarbons present in the overheads is more than 15 wt % (in this case, the overheads is in liquid state). Some crystals will be precipitated at room temperature if the amount of the $C_{11}$-$C_{12}$ hydrocarbons present in the overheads is less than 15 wt % (in this case, the overheads appears to be misted). A new stream of high density fuel with low freezing point mainly containing $C_{10}$-$C_{12}$ hydrocarbons will be produced if the overheads obtained from the distillation column reactor (V-32) is directly fed to the isomerization reactor I-1 without crystallization.

EXAMPLE 3

Figure 8:
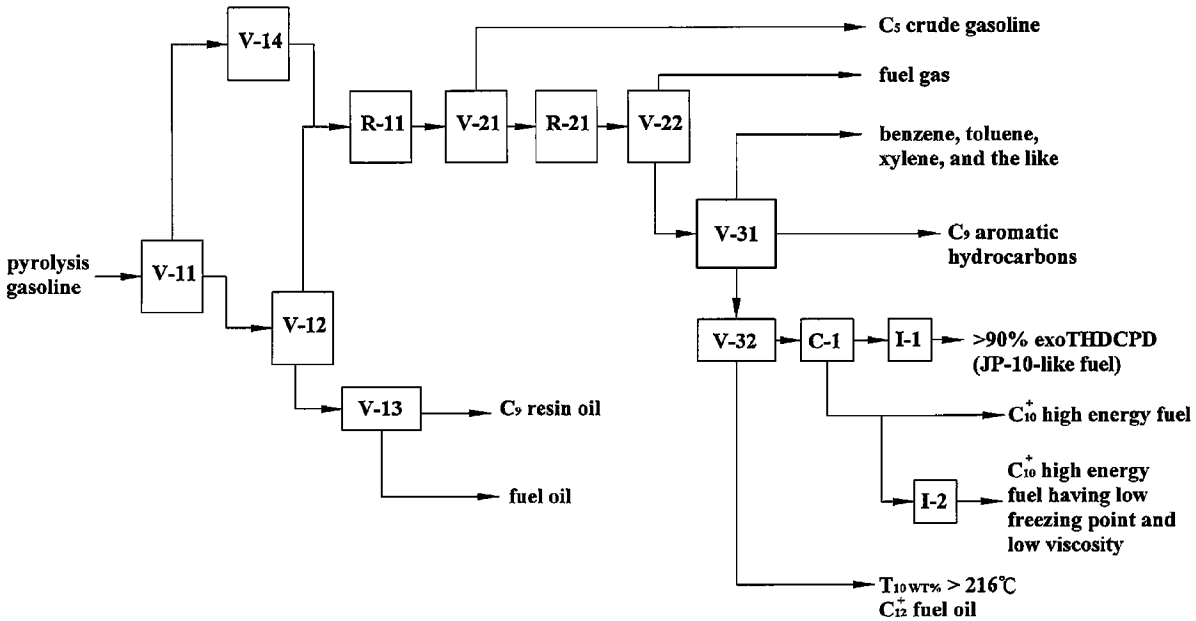
FIG. 8 is a block flow diagram of a sequence of steps for preparing JP-10-like missile fuel and two streams of $C_{10}$-$C_{12}$ high energy fuels from pygas in accordance with the third embodiment of present invention.

CPD is readily dimerized to DCPD as described in Chemical Review, 34, (1944) 1 by J. H. Walls 和 P. J. Wilson. The reaction constant is $1.2\times10^6\exp(-16.7/RT)$L/mol·s. In this example, the amount of the product of exo-THDCPD is increased. As shown in the block flow diagram of FIG. 8, the $C_5$ fraction is separated from the pygas stream in the depentanizer (V-11). Then, the temperature of portions or all of $C_5$ fraction is controlled around 100 to 120° C. Subsequently, the $C_5$ fraction at the temperature ranging from 100 to 120° C. is fed to a heat soaking reactor V-14 for 20 minutes to 2 hours in order to increase the amount of DCPD ($C_{10}$ hydrocarbons) which is the product of dimerization of CPD. Furthermore, the temperature of the heat-soaked product is decreased to 40 to 100° C. Then, the heat-soaked product at the temperature ranging from 40 to 100° C. is mixed with $C_6$-$C_8$ fraction that is to be fed to the first-stage hydrogenation plant (R-11). The follow-on process of this example will follow the same process as described in the block flow diagram of FIG. 7.

Moreover, the pyrgas can be fed to a dehexanizer to separate a $C_5$-$C_6$ fraction as a overheads from a heavier fraction instead of being fed to a depentanizer V-11 as shown in the block flow diagram of FIG. 7. Then, CPD and MCPD contained in $C_5$-$C_6$ fraction are heat soaked in a heat soaking reactor (V-14) to form more amount of DCPD ($C_{10}$ hydrocarbons), CPD/MCPD dimer ($C_{11}$ hydrocarbons), and DMCPD ($C_{12}$ hydrocarbons) as compared with the process as shown in FIG. 7. Consequently, more amount of high density $C_{10}^+$ fraction with relatively broad range of boiling points can be separated out from the distillation column reactor (V-32). As a result, the more amounts of $C_{11}$-$C_{12}$ high energy fuels can be obtained after acid catalytic isomerization of the high density $C_{10}^+$ fraction.

EXAMPLE 4

EXAMPLE 4 will give details in acid catalytic isomerization of endo-isomers of EXAMPLE 1 to EXAMPLE 3. If pygas contains a large amount of $C_{10}$ hydrocarbons, the $C_{10}$-$C_{12}$ derivatives that are produced after dimerization and two-stage hydrogenation will contain a large amount of endo-THDCPD ($C_{10}$ hydrocarbons), which cause the precipitation of endo-THDCPD crystals at room temperature due to supersaturation. Then, 120 g of endo-THDCPD crystals without washing with ethanol are placed in a 250 ml of glass bottle, followed by adding 80 g of dichloromethane thereto to dissolve these crystals, purging with nitrogen to remove residual water and stirring in an ice bath. Subsequently, 15 g of $AlCl_3$ is added to the dichloromethane solution of endo-THDCPD, followed by stirring for 1 hour in the ice bath, and continuously stirring for 3 hours at room temperature. The resulting mixture is washed with 120 ml of saturated KCl solution, followed by adding it to a separatory funnel, shaking to allow to separate into two layers and leaving the upper layer in the separatory funnel. The above saturated KCl solution washing procedure is repeated for three times. Subsequently, the mixture washed with the saturated KCl solution is washed with 100 ml of deionized water, followed by adding it to a separatory funnel, shaking to allow to separate into two layers and leaving the lower layer in the separatory funnel. The above deionized water washing procedure is repeated for three times. Subsequently, the lower layer is distilled to remove dichloromethane and water. The bottoms is collected, and determined by chemical analysis. The chemical analysis shows that the bottoms is composed of 94.6 wt % of exo-THDCPD, 0.6 wt % of endo-THDCPD, 2.1 wt % of exo-THMDCPD, and the other two-stage hydrotreated and saturated $C_{11}^+$ derivatives, namely CPD and/or MCPD dimers. The bottoms has a volumetric beating value of 39.25 MJ/L, a density of 0.9409 at 15° C., and a viscosity of 3.22 cSt at 20° C. and more than 8.81 cSt at −20° C., and Sulfur <1 ppm (by ASTM Method D5453). In this example, the unwanted side products, such as adamantane and decalin, are not produced after isomerization. The properties of the bottoms (the isomerization product) prepared by this example are very similar to those of JP-10 prepared from multi-step chemical synthesis. JP-10 has a volumetric heating value of more than 39.43 MJ/L, a density ranging from 0.935 to 0.943 at 15° C., and a viscosity of less than 10 cSt at −20° C.

EXAMPLE 5

EXAMPLE 5 is the comparative example of EXAMPLE 4.65 g of endo-THDCPD crystals from the same source of EXAMPLE 4 are placed in a 250 ml of glass bottle, followed by adding 40 g of dichloromethane thereto to dissolve these crystals, purging with dry nitrogen and stirring in the ice bath. Subsequently, 10 g of $AlCl_3$ is added to the dichloromethane solution of endo-THDCPD, followed by stirring for 2 hours in the ice bath, and continuously stirring for 16 hours at room temperature. The resulting mixture is washed with 100 ml of saturated KCl solution, followed by adding it to a separatory funnel, shaking to allow to separate into two layers and leaving the upper layer in the separatory funnel. The above saturated KCl solution washing procedure is repeated for three times. Subsequently, the mixture washed with the saturated KCl solution is washed with 100 ml of deionized water, followed by adding it to a separatory funnel, shaking to allow to separate into two layers and leaving the lower layer in the separatory funnel. The above deionized water washing procedure is repeated for three times. Subsequently, the lower layer is distilled to remove dichloromethane and water. The bottoms is collected, and determined by chemical analysis. The chemical analysis shows that the bottoms is composed of 85.7 wt % of exo-THDCPD, 0.5 wt % of endo-THDCPD, 1.2 wt % of Decalin, 5.8 wt % of adamantane, 1.3 wt % of exo-THMDCPD, and the other two-stage hydrotreated and saturated $C_{11}^+$ derivatives, namely CPD and/or MCPD diners. The bottoms has a volumetric heating value of 39.17 MJ/L, a density of 0.9339 at 15° C., and a viscosity of 3.52 cSt at 20° C. and more than 26.7 cSt at −20° C. In this example, the isomerization reaction is violent because isomerization reaction time is too long so that portions of exo-THDCPD is further isomerized to adamantane which will increase the viscosity of the high energy fuel. Under such a violent reaction conditions, a small amount of THDCPD will be ring opened by hydrogen to give decalin (the side product) with relatively less volumetric heating value as well as density. Therefore, the isomerization reaction of this example is not suitable for preparing the high energy fuels because the freezing point of the isomerization product is too high.

In the present invention, the petrochemical products of the $C_5$ olefins, and $C_6$-$C_9$ aromatic hydrocarbons along with the high purity $C_{10}^+$ non-aromatic hydrocarbons which can be converted to the high energy fuels by isomerization are prepared from pygas by-product from naphtha steam cracker.

It will be apparent to those skilled in the art that various modifications and variations can be made in the present invention without departing from the spirit or scope of the present invention. Thus, it is intended that the present invention cover the modifications and the variations of this invention provided they come within the scope of the appended claims and their equivalents.

What is claimed is:

1. A method for preparing high energy fuels, consisting of the following steps:

a) providing a pyrolysis gasoline;

b) distilling the pyrolysis gasoline to separate a $C_5$ fraction from a $C_6$ and heavier fraction, which $C_5$ fraction comprises cyclopentadiene (CPD);

c) distilling the $C_6$ and heavier fraction to separate a $C_6$-$C_8$ fraction from a $C_9$ and heavier hydrocarbon fraction, which $C_9$ and heavier hydrocarbon fraction comprises pre-existing dicyclopentadiene(DCPD) from the pyrolysis gasoline, wherein the $C_9$ and heavier hydrocarbon fraction was pre-existing in the pyrolysis gasoline, and wherein after step c), substantially no additional distillation of pre-existing $C_9$ and heavier hydrocarbons occurs;

d) heat soaking the $C_5$ fraction to form a $C_5$-$C_{12}$ derivative, which $C_5$-$C_{12}$ fraction comprises dicyclopentadiene (DCPD) produced in step d);

e) combining the $C_5$-$C_{12}$ derivative with the $C_6$-$C_8$ fraction;

f) partially hydrogenating non-aromatic unsaturated moieties of the combination of the $C_5$-$C_{12}$ derivative and the $C_6$-$C_8$ fraction to form a first-stage hydrogenated mixture, which first-stage hydrogenated mixture comprises hydrogenated-dicyclopentadienes (hydrogenated DCPD);

g) distilling the first-stage hydrogenated mixture to separate a first-stage hydrogenated $C_5$ fraction, which is used as a petrochemical feedstock, from a first-stage hydrogenated $C_6$-$C_{12}$ fraction, which first-stage hydrogenated $C_6$-$C_{12}$ fraction comprises hydrogenated-DCPD;

h) selectively hydrogenating the remaining non-aromatic unsaturated moieties of the first-stage hydrogenated $C_6$-$C_{12}$ fraction to form a second-stage hydrogenated mixture, which comprises endo-tetrahydrodicyclopentadiene (endo-THDCPD);

i) distilling the second-stage hydrogenated mixture to separate out a $C_6$-$C_9$ aromatic hydrocarbon fraction as a petrochemical product, a $C_{10}$-$C_{12}$ non-aromatic hydrocarbon fraction (endo isomer) including endo-THDCPD including endo-tetrahydrodicyclopentadiene as a precursor of a high energy fuel, and a fraction having a boiling point higher than a boiling point of the $C_{10}$-$C_{12}$ non-aromatic hydrocarbon fraction as a bottoms; and j) isomerizing the $C_{10}$-$C_{12}$ non-aromatic hydrocarbon fraction (endo isomer) including endo-THDCPD with a purity of more than 90 wt % as a precursor of a high energy fuel to a $C_{10}$-$C_{12}$ non-aromatic hydrocarbon fraction (exo isomer) including exo-THDCPD with a purity of more than 90 wt % as a high energy fuel in the presence of acidic catalyst.

2. A method for preparing high energy fuels, consisting of the following steps:

a) providing a pyrolysis gasoline;

b) distilling the pyrolysis gasoline to separate a $C_5$-$C_6$ fraction from a $C_7$ and heavier fraction, which $C_5$-$C_6$ fraction comprises cyclopentadiene (CPD);

c) distilling the $C_7$ and heavier fraction to separate a $C_7$-$C_8$ fraction from a $C_9$ and heavier hydrocarbon fraction, which $C_9$ and heavier hydrocarbon fraction comprises pre-existing dicyclopentadiene (DCPD) from the pyrolysis gasoline, wherein the $C_9$ and heavier hydrocarbon fraction was pre-existing in the pyrolysis gasoline, and wherein after step c), substantially no additional distillation of pre-existing $C_9$ and heavier hydrocarbons occurs;

d) heat soaking the $C_5$-$C_6$ fraction to form a $C_5$-$C_{12}$ derivative, which $C_5$-$C_{12}$ fraction comprises DCPD produced in step d);

e) combining the $C_5$-$C_{12}$ derivative with the $C_7$-$C_8$ fraction;

f) partially hydrogenating non-aromatic unsaturated moieties of the combination of the $C_5$-$C_{12}$ derivative and the $C_7$-$C_8$ fraction to form a first-stage hydrogenated mixture, which first-stage hydrogenated mixture comprises hydrogenated-DCPD;

g) distilling the first-stage hydrogenated mixture to separate a first-stage hydrogenated $C_5$ fraction, which is used as a petrochemical feedstock, from a first-stage hydrogenated $C_6$-$C_{12}$ fraction, which first-stage hydrogenated $C_6$-$C_{12}$ fraction comprises hydrogenated-DCPD;

h) selectively hydrogenating the remaining non-aromatic unsaturated moieties of the first-stage hydrogenated $C_6$-$C_{12}$ fraction to form a second-stage hydrogenated mixture, which comprises endo-THDCPD;

i) distilling the second-stage hydrogenated mixture to separate out a $C_6$-$C_9$ aromatic hydrocarbon fraction as a petrochemical product, a $C_{10}$-$C_{12}$ non-aromatic hydrocarbon fraction (endo isomer) including endo-tetrahydrodicyclopentadiene, endo-tetrahydromethyldicyclopentadiene, and endo-tetrahydrodimethyldicyclopentadiene as a precursor of a high energy fuel, and a fraction having a boiling point higher than a boiling point of the $C_{10}$-$C_{12}$ non-aromatic hydrocarbon fraction as a bottoms; and j) isomerizing the $C_{10}$-$C_{12}$ non-aromatic hydrocarbon fraction (endo isomer) including endo-tetrahydrodicyclopentadiene, endo-tetrahydromethyldicyclopentadiene, and endo-tetrahydrodimethyldicyclopentadiene with an overall purity of more than 90 wt % as a precursor of a high energy fuel to a $C_{10}$-$C_{12}$ non-aromatic hydrocarbon fraction (exo isomer) including exo-tetrahydrodicyclopentadiene, exo-tetrahydromethyldicyclopentadiene, and exo-tetrahydrodimethyldicyclopentadiene with an overall purity of more than 90 wt % as a high energy fuel in the presence of acidic catalyst.

3. The method according to claim 1, wherein in step i) the $C_6$-$C_9$ aromatic hydrocarbon fraction as a petrochemical product having 90 wt % recovered temperature ranging from 174 to 179° C.; the $C_{10}$-$C_{12}$ non-aromatic hydrocarbon fraction as a precursor of a high energy fuel, which has 10 wt % recovered temperature ranging from 181 to 186° C. and has 90 wt % recovered temperature ranging from 210 to 216° C.; and the fraction as a bottoms having 10 wt % recovered temperature ranging from higher than 216° C.

4. The method according to claim 2, wherein in step i) the $C_6$-$C_9$ aromatic hydrocarbon fraction as a petrochemical product having 90 wt % recovered temperature ranging from 174 to 179° C.; the $C_{10}$-$C_{12}$ non-aromatic hydrocarbon fraction as a precursor of a high energy fuel, which has 10 wt % recovered temperature ranging from 181to 186° C. and has 90 wt % recovered temperature ranging from 210 to 216° C.; and the fraction as a bottoms having 10 wt % recovered temperature of higher than 216° C.

5. The method according to claim 1, wherein in step j) the $C_{10}$-$C_{12}$ non-aromatic hydrocarbon fraction as a high energy fuel has a volumetric heating value of more than 39.1 MJ/L, a flash point of higher than 62° C., a viscosity of less than 18 centistokes(cSt) at −20° C., a freezing point of lower than −50° C., a density of more than 0.928 at 15° C., and a sulfur content of less than 5 ppm.

6. The method according to claim 2, wherein in step j) the $C_{10}$-$C_{12}$ non-aromatic hydrocarbon fraction as a high energy fuel has a volumetric heating value of more than 39.0 MJ/L, a flash point of higher than 63° C., a viscosity of less than 19 cSt at −20° C., a freezing point of lower than −48° C., a density of more than 0.925 at 15° C., and a sulfur content of less than 5 ppm.

7. A method for preparing high energy fuels, consisting of the following steps:

a) providing a pyrolysis gasoline;

b) distilling the pyrolysis gasoline to separate a $C_5$ fraction from a $C_6$ and heavier fraction, which $C_5$ fraction comprises cyclopentadiene (CPD);

c) distilling the $C_6$ and heavier fraction to separate a $C_6$-$C_8$ fraction from a $C_9$ and heavier hydrocarbon fraction, which $C_9$ and heavier hydrocarbon fraction comprises pre-existing dicyclopentadiene (DCPD) from the pyrolysis gasoline, wherein the $C_9$ and heavier hydrocarbon fraction was pre-existing in the pyrolysis gasoline, and wherein after step c), substantially no additional distillation of pre-existing $C_9$ and heavier hydrocarbons occurs;

d) heat soaking the $C_5$ fraction to form a $C_5$-$C_{12}$ derivative, which $C_5$-$C_{12}$ fraction comprises DCPD produced in step d);

e) combining the $C_5$-$C_{12}$ derivative with the $C_6$-$C_8$ fraction;

f) partially hydrogenating non-aromatic unsaturated moieties of the combination of the $C_5$-$C_{12}$ derivative and the $C_6$-$C_8$ fraction to form a first-stage hydrogenated mixture, which first-stage hydrogenated mixture comprises hydrogenated-DCPD;

g) distilling the first-stage hydrogenated mixture to separate a first-stage hydrogenated $C_5$ fraction, which is used as a petrochemical feedstock, from a first-stage hydrogenated $C_6$-$C_{12}$ fraction, which first-stage hydrogenated $C_6$-$C_{12}$ fraction comprises hydrogenated-DCPD;

h) selectively hydrogenating the remaining non-aromatic unsaturated moieties of the first-stage hydrogenated $C_6$-$C_{12}$ fraction to form a second-stage hydrogenated mixture, which comprises endo-THDCPD;

i) distilling the second-stage hydrogenated mixture to separate out a $C_6$-$C_9$ aromatic hydrocarbon fraction as a petrochemical product, a $C_{10}$-$C_{12}$ non-aromatic hydrocarbon fraction (endo isomer) including endo-THDCPD as a precursor of a high energy fuel, and a fraction having a boiling point higher than a boiling point of the $C_{10}$-$C_{12}$ non-aromatic hydrocarbon fraction as a bottoms;

j) isolating endo-THDCPD with a purity of more than 90 wt % from the $C_{10}$-$C_{12}$ non-aromatic hydrocarbon fraction (endo isomer) as a precursor of a high energy fuel by a first crystallization under a first low temperature;

k) isomerizing a $C_{11}$-$C_{12}$ non-aromatic hydrocarbon fraction (endo isomer) as a precursor of a high energy fuel contained in a filtrate separated from the first crystallization to an exo-isomer as a high energy fuel in the presence of acidic catalyst; and l) isomerizing endo-THDCPD with the purity of more than 90 wt % to exo-THDCPD with a purity of more than 90 wt % as a high energy fuel in the presence of acidic catalyst.

8. A method for preparing high energy fuels, consisting of the following steps:

a) providing a pyrolysis gasoline;

b) distilling the pyrolysis gasoline to separate a $C_5$-$C_6$ fraction from a $C_7$ and heavier fraction, which $C_5$-$C_6$ fraction comprises cyclopentadiene (CPD);

c) distilling the $C_7$ and heavier fraction to separate a $C_7$-$C_8$ fraction from a $C_9$ and heavier hydrocarbon fraction, which $C_9$ and heavier hydrocarbon fraction comprises pre-existing dicyclopentadiene (DCPD) from the pyrolysis gasoline, wherein the $C_9$ and heavier hydrocarbon fraction was pre-existing in the pyrolysis gasoline, and wherein after step c), substantially no additional distillation of pre-existing $C_9$ and heavier hydrocarbons occurs;

d) heat soaking the $C_5$-$C_6$ fraction to form a $C_5$-$C_{12}$ derivative, which $C_5$-$C_{12}$ fraction comprises DCPD produced in step d);

e) combining the $C_5$-$C_{12}$ derivative with the $C_7$-$C_8$ fraction;

f) partially hydrogenating non-aromatic unsaturated moieties of the combination of the $C_5$-$C_{12}$ derivative and the $C_7$-$C_8$ fraction to form a first-stage hydrogenated mixture, which first-stage hydrogenated mixture comprises hydrogenated-DCPD;

g) distilling the first-stage hydrogenated mixture to separate a first-stage hydrogenated $C_5$ fraction, which is used as a petrochemical feedstock, from a first-stage hydrogenated $C_6$-$C_{12}$ fraction, which first-stage hydrogenated $C_6$-$C_{12}$ fraction comprises hydrogenated-DCPD;

h) selectively hydrogenating the remaining non-aromatic unsaturated moieties of the first-stage hydrogenated $C_6$-$C_{12}$ fraction to form a second-stage hydrogenated mixture, which comprises endo-THDCPD;

i) distilling the second-stage hydrogenated mixture to separate out a $C_6$-$C_9$ aromatic hydrocarbon fraction as a petrochemical product, a $C_{10}$-$C_{12}$ non-aromatic hydrocarbon fraction (endo isomer) including endo-tetrahydrodicyclopentadiene, endo-tetrahydromethyldicyclopentadiene, and endo-tetrahydrodimethyldicyclopentadiene as a precursor of a high energy fuel, and a fraction having a boiling point higher than a boiling point of the $C_{10}$-$C_{12}$ non-aromatic hydrocarbon fraction as a bottoms;

j) isolating endo-tetrahydrodicyclopentadiene with a purity of more than 90 wt % from the $C_{10}$-$C_{12}$ non-aromatic hydrocarbon fraction as a precursor of a high energy fuel by a first crystallization under a first low temperature;

k) isomerizing a $C_{11}$-$C_{12}$ non-aromatic hydrocarbon fraction (endo isomer) including endo-tetrahydromethyldicyclopentadiene, and endo-tetrahydrodimethyldicyclopentadiene with an overall purity of more than 90 wt % as a precursor of a high energy fuel contained in a filtrate separated from the first crystallization to an exo-isomer as a high energy fuel in the presence of acidic catalyst; and l) isomerizing endo-tetrahydrodicyclopentadiene with the purity of more than 90 wt % to exo-tetrahydrodicyclopentadiene with a purity of more than 90 wt % as a high energy fuel in the presence of acidic catalyst.

9. The method according to claim 7, wherein in step i) the $C_6$-$C_9$ aromatic hydrocarbon fraction as a petrochemical product having 90 wt % recovered temperature ranging from 174 to 179° C.; the $C_{10}$-$C_{12}$ non-aromatic hydrocarbon fraction as a precursor of a high energy fuel, which 10 wt % recovered temperature ranging from 181to 186° C. and has 90 wt % recovered temperature ranging from 210 to 216° C.; and the fraction as a bottoms having 10 wt % recovered temperature of higher than 216° C.

10. The method according to claim 8, wherein in step i) the $C_6$-$C_9$ aromatic hydrocarbon fraction as a petrochemical product having 90 wt % recovered temperature ranging from 174 to 179° C.; the $C_{10}$-$C_{12}$ non-aromatic hydrocarbon fraction as a precursor of a high energy fuel, which has 10 wt % recovered temperature ranging from 181to 186° C. and has 90 wt % recovered temperature ranging from 210 to 216° C.; and the fraction as a bottoms having 10 wt % recovered temperature of higher than 216° C.

11. The method according to claim 7, wherein the $C_{11}$-$C_{12}$ non-aromatic hydrocarbon fraction includes monomethyl- and dimethyl-substituted endo-tetrahydrodi cyclopentadiene.

12. The method according to claim 8, wherein the $C_{11}$-$C_{12}$ non-aromatic hydrocarbon fraction includes monomethyl- and dimethyl-substituted endo-tetrahydrodicyclopentadiene.

13. The method according to claim 11, wherein the $C_{10}$-$C_{12}$ non-aromatic hydrocarbon fraction as a high energy fuel has a volumetric heating value of more than 38.7 MJ/L, a flash point of higher than 64° C., a viscosity of less than −20 cSt at −20° C., a freezing point of lower than −65° C., a density of more than 0.918 at 15° C., and a sulfur content of less than 5ppm.

14. The method according to claim 12, wherein the $C_{10}$-$C_{12}$ non-aromatic hydrocarbon fraction as a high energy fuel has a volumetric heating value of more than 38.5 MJ/L, a flash point of higher than 65° C., a viscosity of less than 22 cSt at −20° C., a freezing point of lower than −60° C., a density of more than 0.915 at 15° C., and a sulfur content of less than 5ppm.

15. The method according to claim 7, wherein in step j) the first crystallization is performed under the first low temperature range of 40 to −25° C. for 10 minutes to 1 hour.

16. The method according to claim 8, wherein in step j) the first crystallization is performed under the first low temperature range of 40 to −25° C. for 10 minutes to 1 hour.

17. The method according to claim 1, wherein in step d) heat soaking is performed under a temperature range of 100 to 120° C. for 20 minutes to 2 hours, followed by decreasing the temperature to 40 to 100° C.

18. The method according to claim 2, wherein in step d) heat soaking is performed under a temperature range of 100 to 120° C. for 20 minutes to 2 hours, followed by decreasing the temperature to 40 to 100° C.

19. The method according to claim 7, wherein in step d) heat soaking is performed under a temperature range of 100 to 120° C. for 20 minutes to 2 hours, followed by decreasing the temperature to 40 to 100° C.

20. The method according to claim 8, wherein in step d) heat soaking is performed under a temperature range of 100 to 120° C. for 20 minutes to 2 hours, followed by decreasing the temperature to 40 to 100° C.

21. The method according to claim 1, wherein in step f) partially hydrogenating the non-aromatic unsaturated moieties of the combination of the $C_5$-$C_{12}$ derivative and the $C_6$-$C_8$ fraction is performed at a temperature of 50 to 110° C., a pressure of 400 to 600 psig $H_2$, a liquid hourly space velocity of 1 to 4, an $H_2$/liquid chargestock mole ratio of 1 to 2, and in the presence of a nickel or palladium catalyst, and in step h)

selectively hydrogenating the remaining non-aromatic unsaturated moieties of the first-stage hydrogenated $C_6$-$C_{12}$ fraction is perfoimed at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system.

22. The method according to claim 2, wherein in step f) partially hydrogenating the non-aromatic unsaturated moieties of the combination of the $C_5$-$C_{12}$ derivative and the $C_6$-$C_8$ fraction is performed at a temperature of 50 to 110° C., a pressure of 400 to 600psig $H_2$, a liquid hourly space velocity of 1 to 4, an $H_2$/liquid chargestock mole ratio of 1 to 2, and in the presence of a nickel or palladium catalyst, and in step h) selectively hydrogenating the remaining non-aromatic unsaturated moieties of the first-stage hydrogenated $C_6$-$C_{12}$ fraction is performed at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system.

23. The method according to claim 7, wherein in step f) partially hydrogenating the non-aromatic unsaturated moieties of the combination of the $C_5$-$C_{12}$ derivative and the $C_6$-$C_8$ fraction is performed at a temperature of 50 to 110° C., a pressure of 400 to 600 psig $H_2$, a liquid hourly space velocity of 1 to 4, an $H_2$/liquid chargestock mole ratio of 1 to 2, and in the presence of a nickel or palladium catalyst, and in step h) selectively hydrogenating the remaining non-aromatic unsaturated moieties of the first-stage hydrogenated $C_6$-$C_{12}$ fraction is performed at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system.

24. The method according to claim 8, wherein in step f) partially hydrogenating the non-aromatic unsaturated moieties of the combination of the $C_5$-$C_{12}$ derivative and the $C_6$-$C_8$ fraction is performed at a temperature of 50 to 110° C., a pressure of 400 to 600 psig $H_2$, a liquid hourly space velocity of 1 to 4, an $H_2$/liquid chargestock mole ratio of 1 to 2, and in the presence of a nickel or palladium catalyst, and in step h) selectively hydrogenating the remaining non-aromatic unsaturated moieties of the first-stage hydrogenated $C_6$-$C_{12}$ fraction is performed at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system.

25. The method according to claim 1, wherein in step f) partially hydrogenating the non-aromatic unsaturated moieties of the combination of the $C_5$-$C_{12}$ derivative and the $C_6$-$C_8$ fraction is performed at a temperature of 180 to 250° C., a pressure of 500 to 1000 psig $H_2$, a liquid hourly space velocity of 1 to 2, an $H_2$/liquid chargestock mole ratio of 8 to 12, and in the presence of a sulfided CoMo/NiMo single or dual catalyst system, and in step h) selectively hydrogenating the remaining non-aromatic unsaturated moieties of the first-stage hydrogenated $C_6$-$C_{12}$ fraction is perfoinied at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system.

26. The method according to claim 2, wherein in step f) partially hydrogenating the non-aromatic unsaturated moieties of the combination of the $C_5$-$C_{12}$ derivative and the $C_6$-$C_8$ fraction is performed at a temperature of 180 to 250° C., a pressure of 500 to 1000 psig $H_2$, a liquid hourly space velocity of 1 to 2, an $H_2$/liquid chargestock mole ratio of 8 to 12, and in the presence of a sulfided CoMo/NiMo single or dual catalyst system, and in step h) selectively hydrogenating the remaining non-aromatic unsaturated moieties of the first-stage hydrogenated $C_6$-$C_{12}$ fraction is performed at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system.

27. The method according to claim 7, wherein in step 0 partially hydrogenating the non-aromatic unsaturated moieties of the combination of the $C_5$-$C_{12}$ derivative and the $C_6$-$C_8$ fraction is performed at a temperature of 180 to 250° C., a pressure of 500 to 1000 psig $H_2$, a liquid hourly space velocity of 1 to 2, an $H_2$/liquid chargestock mole ratio of 8 to 12, and in the presence of a sulfided CoMo/NiMo single or dual catalyst system, and in step h) selectively hydrogenating the remaining non-aromatic unsaturated moieties of the first-stage hydrogenated $C_6$-$C_{12}$ fraction is performed at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system.

28. The method according to claim 8, wherein in step f) partially hydrogenating the non-aromatic unsaturated moieties of the combination of the $C_5$-$C_{12}$ derivative and the $C_6$-$C_8$ fraction is perfoimed at a temperature of 180 to 250° C., a pressure of 500 to 1000 psig $H_2$, a liquid hourly space velocity of 1 to 2, an $H_2$/liquid chargestock mole ratio of 8 to 12, and in the presence of a sulfided CoMo/NiMo single or dual catalyst system, and in step h) selectively hydrogenating the remaining non-aromatic unsaturated moieties of the first-stage hydrogenated $C_6$-$C_{12}$ fraction is performed at a temperature of 260 to 350° C., a pressure of 300 to 1000 psig $H_2$, a liquid hourly space velocity of 1 to 2, an $H_2$/liquid chargestock mole ratio of 8 to 15, and in the presence of a sulfided CoMo/NiMo single or dual catalyst system.

* * * * *